US008452216B2

(12) United States Patent
Fujita et al.

(10) Patent No.: US 8,452,216 B2
(45) Date of Patent: May 28, 2013

(54) IMAGE FORMING APPARATUS WHICH MIXES NEW UNUSED TONER WITH USED OLD TONER

(75) Inventors: Tetsumaru Fujita, Hyogo (JP); Atsushi Takehara, Kyoto (JP); Naoki Nakatake, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 302 days.

(21) Appl. No.: 12/880,452

(22) Filed: Sep. 13, 2010

(65) Prior Publication Data

US 2011/0064473 A1 Mar. 17, 2011

(30) Foreign Application Priority Data

Sep. 15, 2009 (JP) ..... 2009-213148

(51) Int. Cl.
*G03G 15/08* (2006.01)

(52) U.S. Cl.
USPC ..... 399/255

(58) Field of Classification Search
USPC ..... 399/254, 255, 258
See application file for complete search history.

(56) References Cited

U.S. PATENT DOCUMENTS

| | | | | |
|---|---|---|---|---|
| 4,354,763 | A * | 10/1982 | Koiso et al. | 399/255 X |
| 5,307,128 | A * | 4/1994 | Murasaki et al. | 399/255 |
| 5,734,957 | A * | 3/1998 | Ogawa et al. | 399/255 X |
| 6,226,490 | B1 * | 5/2001 | Fujita et al. | 399/359 |
| 6,345,163 | B1 * | 2/2002 | Suzuki et al. | 399/255 X |
| 7,079,793 | B2 | 7/2006 | Amano et al. | |
| 7,561,835 | B2 | 7/2009 | Tanaka et al. | |
| 7,599,650 | B2 | 10/2009 | Katoh et al. | |
| 7,881,644 | B2 * | 2/2011 | Okamoto et al. | 399/258 |
| 2008/0145109 | A1 * | 6/2008 | Murayama et al. | 399/260 |
| 2009/0067887 | A1 | 3/2009 | Fujita et al. | |
| 2009/0220266 | A1 | 9/2009 | Shiraishi et al. | |
| 2009/0245885 | A1 * | 10/2009 | Okamoto et al. | 399/263 |

FOREIGN PATENT DOCUMENTS

| | | |
|---|---|---|
| CN | 1629746 A | 6/2005 |
| CN | 1959556 A | 5/2007 |
| JP | 6-69960 | 9/1994 |
| JP | 3459860 | 8/2003 |
| JP | 2006-308901 | 11/2006 |

OTHER PUBLICATIONS

Chinese Office Action issued Mar. 21, 2012, in China Patent Application No. 201010282989.1 (with English translation).

* cited by examiner

*Primary Examiner* — Sandra Brase
(74) *Attorney, Agent, or Firm* — Oblon, Spivak, McClelland, Maier & Neustadt, L.L.P.

(57) ABSTRACT

An image forming apparatus includes an image carrier on which a latent image is formed, a charging device that charges the image carrier, an exposing device that irradiates the image carrier, thereby forming a latent image on the image carrier, a developing device that develops the latent image into a visible image by using a monocomponent developer that is carried and transferred by a developer carrier and that is charged to a predetermined polarity, and a toner supply container that is installed in the developing device for toner supply. Used old toner is conveyed from the developing device to the toner supply container and mixed with unused new toner within the toner supply container and thus a mixed toner is produced, and the mixed toner is supplied to the developing device.

9 Claims, 6 Drawing Sheets

IMAGE FORMING APPARATUS WHICH MIXES NEW UNUSED TONER WITH USED OLD TONER

CROSS-REFERENCE TO RELATED APPLICATIONS

The present application claims priority to and incorporates by reference the entire contents of Japanese Patent Application No. 2009-213148 filed in Japan on Sep. 15, 2009.

BACKGROUND OF THE INVENTION

1. Field of the Invention

The present invention relates to image forming apparatuses, such as copying machines, facsimile machines, and printers and, more particularly, to image forming apparatuses that include a toner supply container that is used to mix new toner and old toner.

2. Description of the Related Art

In electrophotographic image forming apparatuses, a drum-shaped photosensitive element is evenly charged using a charging roller and then a latent image is formed on the photosensitive element by scanning it with a laser beam. The latent image is then developed into a visible image with toner accommodated in a developing device.

A recording medium or a transfer sheet receives the visible image at the position where the photosensitive element comes into contact with a transferring roller, and the toner of the image is melted and fixed to the transfer sheet by a fixing device.

The developing device includes a developing roller that serves as a developer carrier; a supplying roller that supplies non-magnetic monocomponent toner (negatively charged) to the developing roller; a stirring member that conveys, within a container, toner to be closer to the supplying roller; and a developing blade that serves as a developer adjusting member and adjusts the amount of toner on the developing roller. Because the developing roller comes into contact with the photosensitive element, the developing roller is made of an elastic material. In most cases, the developing blade is brought into press-contact by the spring force of a sheet of metal. During development, in order to transfer toner from the developing roller to the photosensitive element, the developing roller is charged to a predetermined potential by a developing-bias power supply.

The developing blade of the developing device is connected to a blade-bias power supply so that the toner maintains a certain amount of charge. There are various types of blade-bias power supplies, for example, a blade-bias power supply that charges to the same potential as the developing-bias power supply and a blade-bias power supply that charges to a different potential.

For example, in one case, the developing roller always has a negative charge of 300 volts from the developing-bias power supply and the developing blade always has a negative charge of 400 volts from the blade-bias power supply so that there is a potential difference of about 100 volts between the developing roller and the developing blade. This allows the toner to maintain a certain amount of charge and is effective in preventing the leakage of toner. In another case, an AC bias is applied constantly to the developing blade.

When such an image forming apparatus prints out a large number of copies, toner is consumed during the printing. Hence, it is necessary to supply toner after such a large amount of printing. The toner supply involves, in general, removing a sealing member from a toner supply container that contains toner, opening a lid of the developing device, and supplying the toner to the developing device of an electrostatic recording device.

Mutual charging occurs between the new toner that is newly supplied to the developing device and the old toner that has been used by the developing device. As a result, the charge of the new toner increases, while the charge of the old toner, which is present in the developing device before the toner supply, decreases or even goes toward the opposite polarity. This leads to a malfunction such as increased scumming.

The reason why the mutual charging occurs is described below. The new toner in the developing device is subjected to stress, during the printing operation, when passing through the supplying roller, the developing roller, the developing blade, and the photosensitive element. Due to the stress, an external additive agent is removed from particles of the toner or embedded inside the particles from the surface. Moreover, some particles of the toner are modified or broken into pieces. Eventually, the electric potential of the old toner decreases. When the old toner is mixed with the new toner, i.e., the two toners having different electric potentials are mixed with each other, electric interaction occurs between the different toners. As a result, the charge of one toner increases relative to the charge before mixing and the charge of the other toner decreases relative to the usual charge.

In actual image formation, a technology is needed for suppressing the mutual charging that occurs within the developing device, thereby maintaining the image quality at a high level with no scumming.

Utility Model Application No. 6-69960 discloses a toner supplying device that is used in a recording device. The toner supplying device includes a toner supply container that has an opening and contains toner therein. The toner supplying device supplies the toner from the toner supply container to a developing device. The toner supplying device includes a toner supply port from which the toner is supplied; a supporting member that supports the toner supply container so that the opening fits with the toner supply port; and a vibration dampener that is provided on the supporting member. The toner supplying device supplies the toner by vibrating the toner supply container. Utility Model Application No. 6-69960 discloses a toner supplying device that can supply toner from the toner supply container to the developing device in an efficient manner but it does not state that used old toner is mixed with unused new toner in the toner supply container.

Japanese Patent No. 3459860 discloses a developing device that is arranged on a substantially horizontal plane and provided with a toner supply container. The toner supply container rotates around the axis thereof to supply toner. When the container becomes empty after toner supply, degraded developer is conveyed to the container for developer collection. The container has an opening with a cap. The opening position of the cap during the toner supply is different from the opening position of the cap during the developer collection. Japanese Patent No. 3459860 discloses technology related to the shape of the toner supply container but it does not state that used old toner is mixed with unused new toner in the toner supply container.

SUMMARY OF THE INVENTION

It is an object of the present invention to at least partially solve the problems in the conventional technology.

According to one aspect of the present invention, an image forming apparatus includes: an image carrier on which a latent image is formed; a charging device that charges the image carrier; an exposing device that irradiates the image carrier, thereby forming a latent image on the image carrier; a developing device that develops the latent image into a visible image by using a monocomponent developer that is carried and transferred by a developer carrier and that is charged to a predetermined polarity; and a toner supply container that is installed in the developing device for toner supply, wherein used old toner is conveyed from the developing device to the toner supply container and mixed with unused new toner within the toner supply container and thus a mixed toner is produced, and the mixed toner is supplied to the developing device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. One skilled in the art can easily make another embodiment by modifying/revising the present invention within the scope of the invention. It is noted that any such modifications/revisions are included in the scope of the invention. The following embodiments are merely examples of the best modes and do not limit the scope of the invention.

Figure 1:
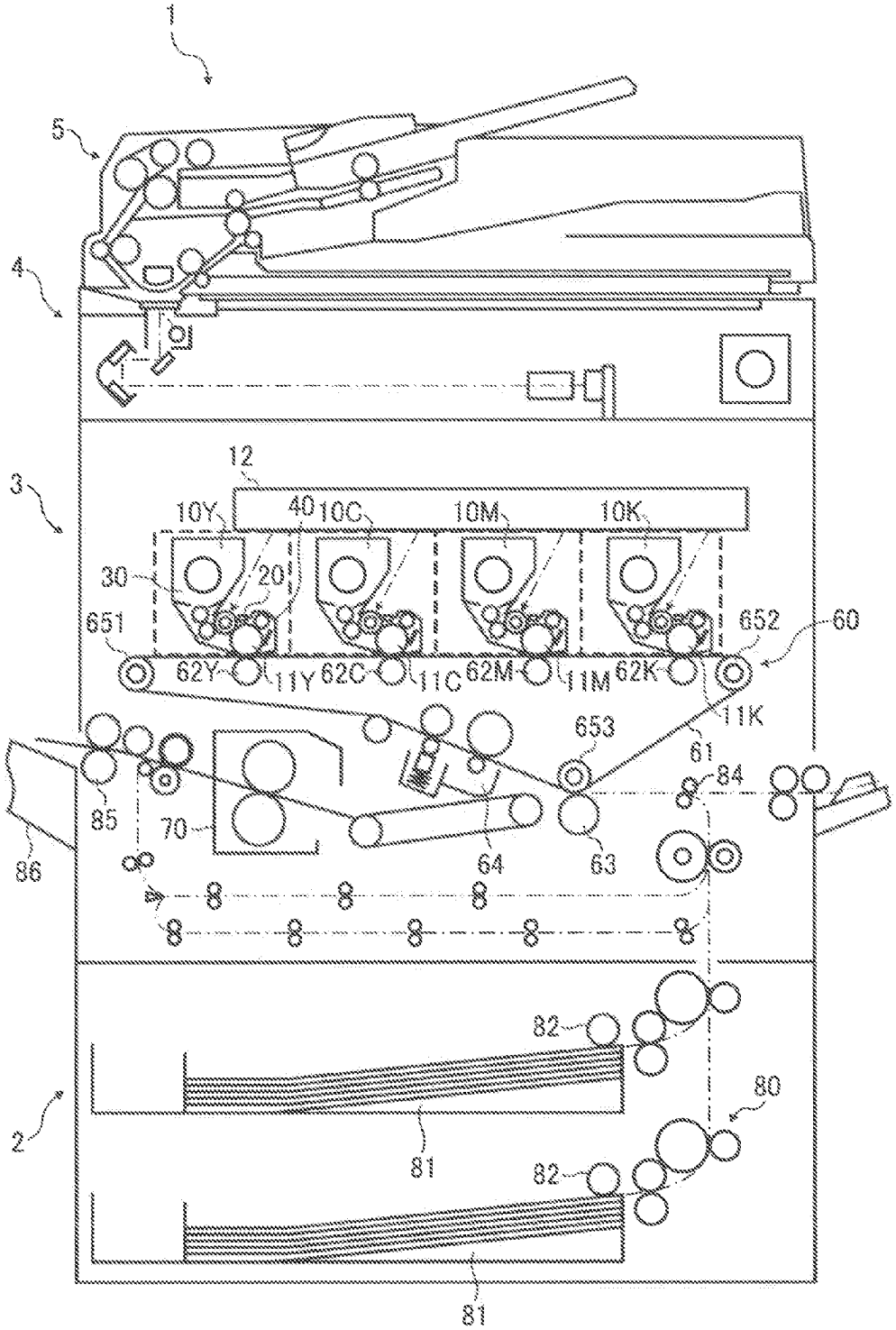
FIG. 1 is a schematic diagram of an image forming apparatus according to an embodiment of the present invention and including four image forming units arranged in tandem and an intermediate transfer belt to which a toner image is transferred.

The following description is made by using a full-color image forming apparatus as an example of the present invention. FIG. 1 is a schematic diagram of an image forming apparatus according to the embodiment of the present invention. The image forming apparatus includes four image forming units arranged in tandem and an intermediate transfer belt to which a toner image is transferred.

An image forming apparatus 1 according to the present invention includes an automatic document feeder (ADF) 5 that automatically feeds an original placed thereon; a scanner (reading device) 4 that reads the original; an image forming device 3 that forms a toner image; and a paper feeding unit 2 that is under the image forming device 3 and stores therein recording members, such as recording sheets, and feeds a recording member therefrom. These units are arranged in this order from the top.

The image forming device 3 is in the middle of the image forming apparatus 1. The image forming device 3 includes, in the middle thereof, four process cartridges or four image forming units 10 (10Y, 10C, 10M, and 10K) for yellow (Y) toner, magenta (M) toner, cyan (C) toner, and black (K) toner, arranged side by side on a horizontal plane parallel to each other in a tandem manner. Above the four image forming units 10Y, 10C, 10M, and 10K is an exposing device 12 that irradiates the surface of each of charged photosensitive elements 11 (11Y, 11C, 11M, and 11K) in accordance with color-based image data, thereby forming latent images. Under the four image forming units 10Y, 10C, 10M, and 10K is a transferring device 60 that includes an intermediate transfer belt 61. The intermediate transfer belt 61 is an endless belt made of a heat resistant material, such as polyimide and polyamide, adjusted to have a middle-level resistance. The intermediate transfer belt 61 is rotatably supported by rollers 651 and 652.

All the image forming units 10 have the same configuration; therefore, in the drawings and the description, the letters Y, C, M, and K are omitted if there is no need to identify the colors. The image forming units 10Y, 10C, 10M, and 10K include the photosensitive elements 11Y, 11C, 11M, and 11K, respectively. Around each photosensitive element 11 are a charging device 20 that charges the surface of the photosensitive element 11, a developing device 30 that develops the latent image formed on the surface of the photosensitive element 11 into a toner image with the corresponding color toner, a lubricant applying device (not shown) that applies a lubricant to the surface of the photosensitive element 11, and a cleaning device 40 that includes a cleaning blade and cleans the surface of the photosensitive element 11 after the toner image is transferred. These components together form the image forming unit 10. In the present embodiment, the image forming unit 10 and at least one of the photosensitive element 11, the charging device 20, the developing device 30, the cleaning device 40, and the lubricant applying device are formed integrally, and they are detachable from the image forming apparatus 1 as a process cartridge. So long as the image forming unit 10 operates, some devices other than the above-described devices can be included in the image forming unit 10.

The photosensitive element 11 is made of amorphous silicon, metal, such as selenium, or an organic photosensitive element. The photosensitive element 11 in the present embodiment is an organic photosensitive element. The organic photosensitive element 11 includes a conductive supporting member, a resin layer containing dispersed filler that is formed on the conductive supporting member, a photosensitive layer that has a charge generating layer and a charge transporting layer, and a protective layer containing dispersed filler that is formed on the photosensitive layer.

Although the photosensitive layer can be either a single layer that has both a charge generating material and a charge transporting material or a lamination that is made of a charge generating layer and a charge transporting layer, the lamination is superior in the sensitivity and the durability.

The charge generating layer is formed by dispersing charge generating pigments and binder resin, if necessary, in a solvent using a ball mill, an attritor, a sand milling, an ultrasonic technique, etc., applying the solvent to the conductive supporting member, and drying it. The binder resin can be, for example, polyamide, polyurethane, epoxy resin, polyketone, polycarbonate, silicone resin, acrylate resin, polyvinyl butyral, polyvinyl formal, polyvinyl ketone, polystyrene, polysulfone, poly-N-vinyl carbazole, polyacrylamide, polyvinyl benzar, polyester, phenoxy resin, vinyl chloride-vinyl acetate copolymers, polyvinyl acetate, polyphenylene oxide, polyamide, polyvinylpyridine, cellulosic resin, casein, polyvinyl alcohol, and polyvinylpyrrolidone. The amount of the binder resin is from 0 to 500 parts by mass per 100 parts by mass of the charge generating material and, preferably, from 10 to 300 parts by mass.

The charge transporting layer can be formed by resolving or dispersing a charge transporting material and a binder resin in a solvent, applying the solvent to the charge generating layer, and drying it. The charge transporting material includes a hole transporting material and an electron transporting material. The binder resin is, for example, a thermoplastic or thermosetting resin, such as polystyrene, styrene-acrylonitrile copolymer, styrene-butadiene copolymer, styrene-maleic anhydride copolymer, polyester, polyvinyl chloride, vinyl chloride-vinyl acetate copolymers, polyvinyl acetate, polyvinylidene chloride, polyarylate, phenoxy resin, polycarbonate, acetylcellulose resin, ethyl cellulose resin, polyvinyl butyral, polyvinyl formal, polyvinyl toluene, Poly(N-vinylcarbazole), acrylate resin, silicone resin, epoxy resin, melamine resin, urethane resin, phenol resin, and alkyd resin.

The protective layer can be formed on the photosensitive layer. Presence of the protective layer improves the durability and thus a highly sensitive and defectless photosensitive element 11 is produced.

The protective layer is made of, for example, resin such as ABS resin, ACS resin, olefin-vinyl monomer copolymer, chlorinated polyether, allyl resin, phenol resin, polyacetal, polyamide, polyamide-imide, polyacrylate, polyallylsulfone, polybutylene, polybutylene terephthalate, polycarbonate, polyarylate, polyether sulfone, polyethylene, polyethylene terephthalate, polyimide, acrylate resin, polymethylpentene, polypropylene, polyvinylidene chloride, and epoxy resin. Polycarbonate or polyarylate is preferable. In order to improve the abrasion resistance of the protective layer, it is possible to add a fluorine resin, such as polytetrafluoroethylene, silicone resin, or a fluorine resin or a silicone resin doped with dispersed inorganic filler, such as titanium oxide, tin oxide, potassium titanate, and silica, or doped with dispersed organic filler. Although the filler density in the protective layer varies depending on the type of the filler or the electrophotographic processing conditions of the photosensitive element 11, the outermost layer of the protective layer contains the filler with 5% by mass to the total dissolved solid or higher, preferably, from 10% by mass to 50% by mass, and more preferably, about 30% by mass or lower.

The charging device 20 includes a charging roller 21 as a charging member. The charging roller 21 includes a conductive cored bar and a middle-level resistant elastic layer that covers the surface of the conductive cored bar. The charging roller 21 is connected to a power supply (not shown) and charged to a predetermined direct-current voltage (DC) and/or a predetermined alternating-current voltage (AC). The ion-discharging charging roller 21 is an elastic resin roller. For adjustment of the electric resistance, the charging roller 21 can be configured to contain an inorganic conductive material, such as carbon black, and an ionic conductor.

The charging roller 21 is arranged apart from the photosensitive element 11 with a small gap therebetween. This small gap is made by, for example, winding spacer members with a predetermined thickness around non-image forming areas at the both ends of the charging roller 21 so that the surfaces of the spacer members are in contact with the surface of the photosensitive element 11. Alternatively, the charging roller 21 can be in contact with the photosensitive element rather than being placed closely thereto. The charging roller 21 is in a roller-shape, and able to discharge electricity from the area close to the photosensitive element 11 so as to charge the photosensitive element 11. If the charging roller 21 is close to the photosensitive element 11 but not in contact therewith, the charging roller 21 is prevented from being stained with residual toner. The charging roller 21 has a charge cleaner roller (not shown) that comes into contact with the surface of the charging roller 21 and cleans the surface of the charging roller 21.

The developing device 30 is opposed to the photosensitive element 11. The developing device 30 will be described in detail later.

The cleaning device 40 has a mechanism that moves the cleaning blade into contact with the photosensitive element 11 and away from the photosensitive element 11. Under the instruction of a control unit of the main body of the image forming apparatus, the cleaning blade comes into contact with the photosensitive element 11 and moves away from the photosensitive element 11. The cleaning blade comes into contact with the photosensitive element 11 in a counter manner, thereby cleaning the photosensitive element 11 or removing stains, for example, toner and recording-member additive agents, such as talc, kaolin, and calcium carbonate from the photosensitive element 11. The removed toner, etc., is conveyed by a used-toner collecting coil to a used-toner container (not shown) and stored in the used-toner container.

The transferring device 60 includes the intermediate transfer belt 61 on which the toner images are superimposed; primary-transfer rollers 62 (62Y, 62M, 62C, and 62K) that transfer the toner images from the photosensitive elements 11 to the intermediate transfer belt 61 in a superimposed manner; a secondary-transfer roller 63 that transfers the superimposed toner images onto the recording member; etc. The transferring device 60 further includes an opposed member inside the intermediate transfer belt 61 so that the opposed member is opposed to the secondary-transfer roller 63.

Each primary-transfer roller 62 is opposed to the corresponding photosensitive element 11 across the intermediate transfer belt 61 so that the primary-transfer roller 62 transfers the toner image from the photosensitive element 11 onto the intermediate transfer belt 61 during the primary transfer. The primary-transfer roller 62 is connected to a power supply (not shown) and charged to a predetermined direct-current voltage (DC) and/or a predetermined alternating-current voltage (AC). The polarity of the applied voltage is opposite to the polarity of the toner charged voltage. The toner is attracted from the photosensitive element 11 to the intermediate transfer belt 61 and then attached to the intermediate transfer belt 61 during the primary transfer. For adjustment of the electric resistance, it is preferable to use, as the primary-transfer roller 62, a semi-conductor that contains an inorganic conductive material, such as carbon black, and an ionic conductor. The transcription efficiency is almost unaffected by the resistance value of the primary-transfer roller 62; however, the transcription efficiency largely depends on the image area ratio. Therefore, stable transcription efficiency will not be maintained. This is because a current preferentially flows to a part with no toner at a transfer nip and, therefore, if the image area ratio is low, the transferring voltage decreases to a level insufficient to produce an electric field necessary for the transfer. If, especially, the resistance value of the primary-transfer roller 62 is low, the effect of the resistance value of the toner present on the transferring unit is large; therefore, as the resistance value of the primary-transfer roller 62 decreases, the transcription efficiency becomes more unstable. Therefore, if a constant current control is used, the primary-transfer roller 62 is preferably a roller with a high resistance value.

The toner images formed on the intermediate transfer belt 61 in a superimposed manner is transferred by the secondary-transfer roller 63 to the recording member during the secondary transfer. In the same manner as the primary-transfer roller 62, the secondary-transfer roller 63 is connected to a power supply (not shown) and charged to a predetermined direct-current voltage (DC) and/or a predetermined alternating-current voltage (AC). The polarity of the applied voltage is opposite to the polarity of the toner charged voltage. The toner is attracted from the intermediate transfer belt 61 to the recording member and then attached to the recording member during the secondary transfer.

The intermediate transfer belt 61 has an intermediate-transfer-belt cleaning device 64 for cleaning the surface of the intermediate transfer belt 61 after the secondary transfer. A rotating member has a mechanism that moves the rotating member into contact with the intermediate transfer belt 61 and away from the intermediate transfer belt 61. Under the instruction of the control unit of the main body of the image forming apparatus 1, the rotating member comes into contact with the intermediate transfer belt 61 and moves away from the intermediate transfer belt 61. The rotating member comes into contact with the intermediate transfer belt 61, thereby cleaning the intermediate transfer belt 61 or removing stains, for example, toner and recording-member additive agents from the intermediate transfer belt 61. The removed toner, etc., is stored in a container (not shown).

The image forming apparatus 1 further includes the lubricant applying device that applies a lubricant to the intermediate transfer belt 61. The rotating lubricant applying device applies a lubricant that has been scribed off to the surface of the intermediate transfer belt 61. Another lubricant applying device may be provided to apply a lubricant to the photosensitive element 11.

A solid lubricant that can be used in the present embodiment includes, for example, a solid hydrophobic lubricant in a dried state, zinc stearate, and a metallic compound that contains fatty acid substrate, such as stearic acid, oleic acid, and palmitate. Waxes or similar can be used that include candelilla wax, carnauba wax, rice wax, Japanese wax, jojoba oil, bees wax, and lanolin.

Under the transferring device 60 is a fixing device 70 that semipermanently fixes the toner image onto the recording sheet. The fixing device 70 includes, as main components, a fixing roller and a pressing roller that is opposed to and in press-contact with the fixing roller. The fixing roller includes a halogen heater (not shown). Under the control of a control unit (not shown), the fixing device 70 changes fixing conditions depending on a full-color image or a monochrome image, one-side printing or both-side printing, and the type of the sheet, thereby setting most-suitable fixing conditions.

The image forming operation begins with formation of a color-based latent image on the surface of each photosensitive element 11 by irradiating the negatively charged photosensitive element 11 with a laser beam emitted from the exposing device 12. The developing device 30 then develops the latent image into a visible image with the corresponding color toner that is charged (negatively) in the same polarity as the polarity of the charged photosensitive element 11, thereby performing reversal development. During the reversal development, the endless intermediate transfer belt 61 is rotating, supported by the rollers 651, 652, and 653 so that developed part of each of the photosensitive elements 11Y, 11C, 11M, and 11K is in contact with the intermediate transfer belt 61. The intermediate transfer belt 61 receives the toner images from the photosensitive elements 11Y, 11C, 11M, and 11K by the primary-transfer rollers 62Y, 62C, 62M, and 62K in a superimposed manner during the primary transfer and thus an unfixed image is formed on the intermediate transfer belt 61. Around the outer circumference of the intermediate transfer belt 61 is the belt cleaning device 64 arranged opposed to a cleaning backup roller. The belt cleaning device 64 removes unnecessary toner and foreign materials, such as paper powders, from the surface of the intermediate transfer belt 61. Moreover, around the outer circumference of the intermediate transfer belt 61 is the secondary-transfer roller 63 arranged opposed to the supporting roller 653. By an effect of a bias that is applied to the secondary-transfer roller 63 when the recording member passes through between the intermediate transfer belt 61 and the secondary-transfer roller 63, the toner image is transferred from the intermediate transfer belt 61 to the recording member. The polarity of the transfer voltage that is applied to the secondary-transfer roller 63 is positive, opposite to the polarity of the toner charged voltage. These members related to the intermediate transfer belt 61 and the intermediate transfer belt 61 integrally form the transferring device 60, and they are detachable from the image forming apparatus 1.

The image forming apparatus 1 has, in the lower part, a feeding device 80 that includes a paper-feed cassette 81. The paper-feed cassette 81 stores therein the recording members and feeds the recording members therefrom. The recording members are conveyed by a conveying roller 82 one by one from the paper-feed cassette 81 to a pair of registration rollers 84. After passing through the secondary-transfer roller 63, the recording member is conveyed to the fixing device 70 downstream in the conveying direction. After the toner image is fixed to the recording member, the recording member is conveyed by a discharging roller 85 out of the image forming apparatus 1 and is stacked on a discharge tray 86.

The image forming station 10 shown in FIG. 1 and used in the image forming apparatus 1 according to the present invention also works as a process cartridge. As shown in FIG. 1, the process cartridge 10 includes the charging device 20, the developing device 30, and the cleaning device 40 around the photosensitive element 11. It is enough for the process cartridge 10 to have at least the photosensitive element 11 and the related process devices. When the photosensitive element 11 is irradiated from above with laser light that is emitted from the exposing device 12, a latent image is formed on the photosensitive element 11.

Figure 2:
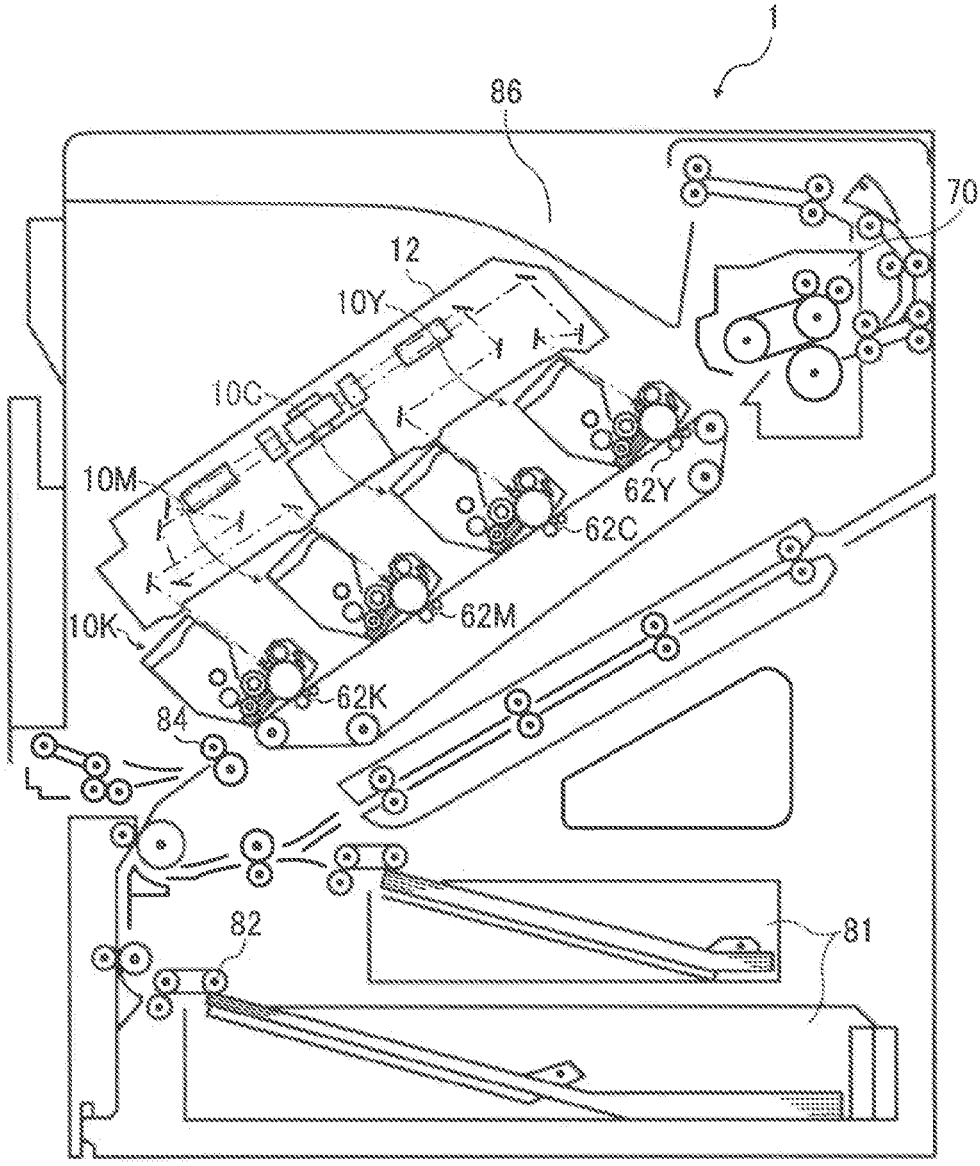
FIG. 2 is a schematic diagram of the configuration of an image forming apparatus according to another embodiment of the present invention.

FIG. 2 is a schematic diagram of the configuration of an image forming apparatus according to another embodiment of the present invention. As is different from the image forming apparatus 1 shown in FIG. 1, the intermediate transfer belt 61 is not included and a recording sheet passes through the four image forming units 10Y, 100, 10M, and 10K for yellow, cyan, magenta, and black, which are arranged side by side, so that the toner images are transferred directly from the image forming units onto the recording sheet in a superimposed manner. After that, in the same manner as in the image forming apparatus 1 shown in FIG. 1, the recording sheet is conveyed to the fixing device 70 and the heat and pressure are applied to the recording sheet, and thus the toner image is fixed onto the recording sheet. The full-color image is then output.

Figure 3:
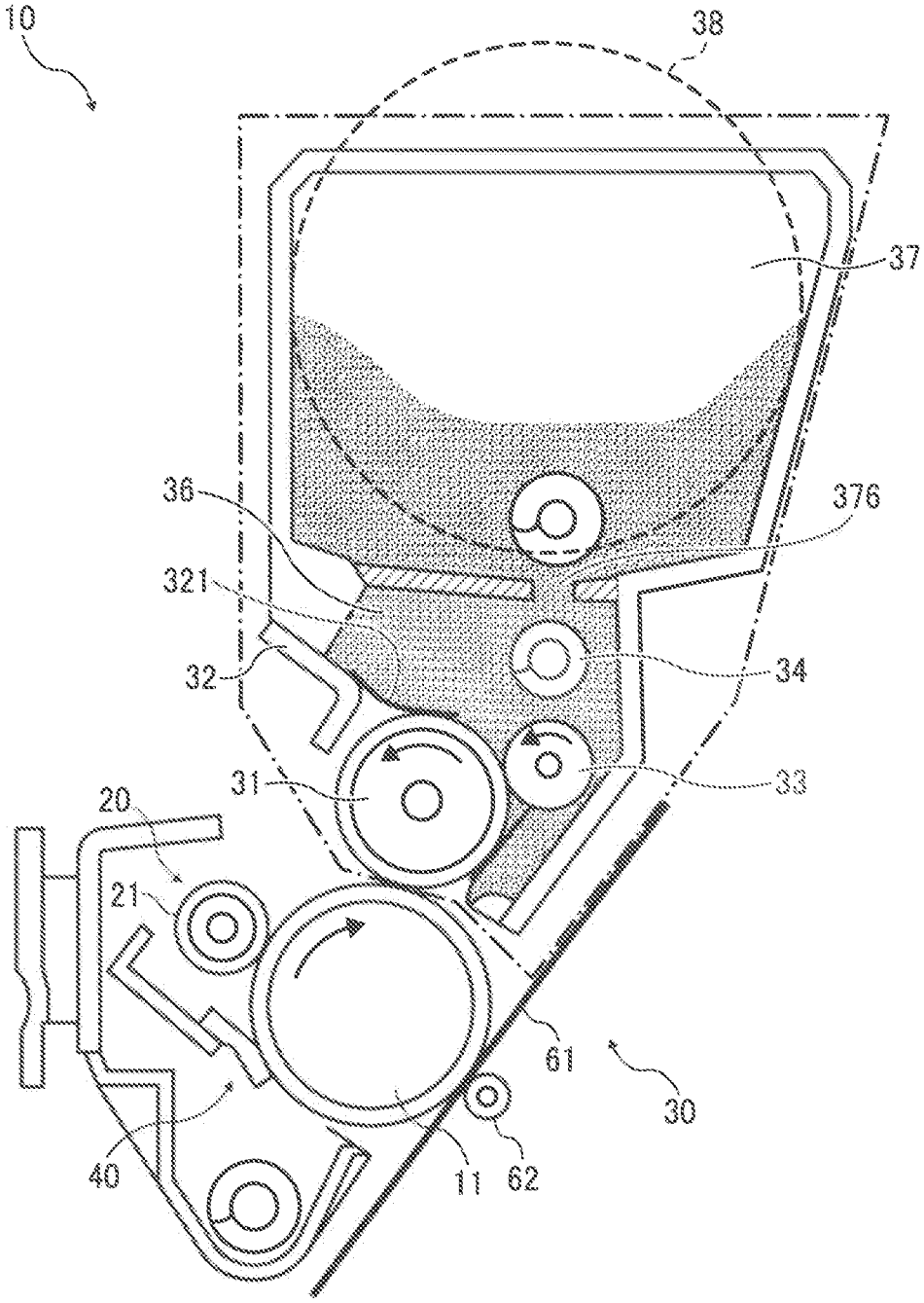
FIG. 3 is a schematic diagram of a process cartridge used in the image forming apparatus according to the present invention.

FIG. 3 is a schematic diagram of the process cartridge used in the image forming apparatus according to the present invention. The process cartridge 10 includes the charging device 20, the developing device 30, and the cleaning device 40 around the photosensitive element 11. It is enough for the process cartridge 10 to have at least the photosensitive element 11 and the related process devices. When the photosensitive element 11 is irradiated from above with the laser light that is emitted from the exposing device 12, a latent image is formed on the photosensitive element 11. The charging device 20 and the cleaning device 40 have been described in the above. The process cartridge 10 can further include the lubricant applying device that applies a lubricant onto the photosensitive element 11. The lubricant is made of, for example, resin, such as fluorine resin and silicone resin, and metallic stearate compound such as zinc stearate and aluminum stearate.

The developing device 30 includes a toner storage unit 36 that stores therein a developer and a developing roller 31 that is opposed to the photosensitive element 11 and develops the latent image formed on the photosensitive element 11 with the developer. The toner storage unit 36 includes a supplying roller 33 that is a developer supplying member used to supply the developer to the developing roller 31 or the developer carrier. The toner storage unit 36 further includes a stirring roller 34 as a developer stirring member.

The configuration of the developing device is described below. The developing roller 31 has a cored bar with the diameter ϕ 6 mm, a conductive urethane with the diameter ϕ 12 mm, and a relatively high-resistance elastic material with the volume resistance $5\times10^6\Omega\cdot$cm or higher. The supplying roller 33 is made of conductive carbon-contained urethane foam and has the diameter ϕ 10 mm. A shaping blade 32 is a stainless blade with the thickness t 0.1 mm. The end of the shaping blade 32 is bended in L-shaped so that the shaping blade 32 can shape a toner layer. The shaping blade 32 is in press-contact with the developing roller 31, thereby applying −100 volts to the developing roller 31. An intake-port seal 321 is made of conductive PTFE with the volume resistance from $1\times10^0\Omega\cdot$cm to $1\times10^5\Omega\cdot$cm and has the same potential as the developing roller 31. The intake-port seal 321 neutralizes the toner that is present on the developing roller 31 and returns the neutralized toner to the developing layer.

The speed of the developing roller 31 is 20 ppm; the linear speed of the photosensitive element is 120 mm/s; the linear speed ratio of the developing roller is 1.4; the developing roller and the photosensitive element rotates in the same direction; the supplying roller rotates in the reverse direction and has the diameter ϕ 10 mm and the linear speed ratio 1.0.

The developing device 30 of the present embodiment uses a single-component developer. The single-component developer may contain magnetic toner or nonmagnetic toner. For the image forming apparatus 1 that is used in the present embodiment to form a color image, nonmagnetic toner is preferable. The toner used in the present embodiment is powders with the volume average particle diameter 8.5 μm and uses polyester resin as a binder resin. Therefore, the developing device 30 can convey, without carrier or stirring/mixing medium, the developer smoothly without the developer being applied with stress or stalled in the developing device 30. Moreover, a toner supply container 37 is arranged above the toner storage unit 36. The toner supply container 37 will be described in detail later.

A detachable additional supply container 38 filled with toner is set to the developing device 30. If a shortage of toner occurs in the developing device 30, new toner is supplied from the additional supply container 38 so as to keep the printing operation going on. The time to supply toner may be determined by using a detection unit that detects the absence of toner in the toner supply container 37 or a shortage of toner in the developing device 30 or by predicting the amount of consumption using a printing dot counter. As for the amount of toner supplied, the toner may be supplied with a fixed amount at predetermined timings or almost all the toner in the additional supply container 38 may be supplied at one time.

Figure 4A:
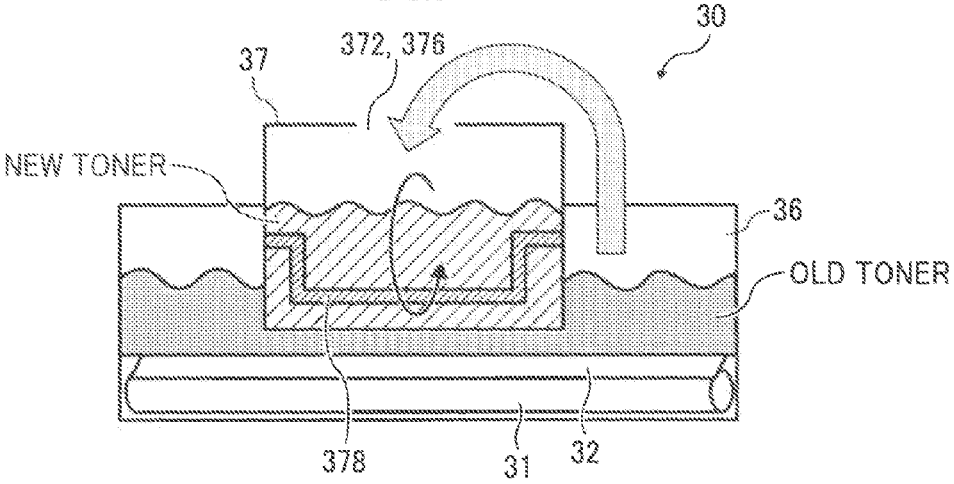
FIGS. 4A to 4C are schematic diagrams of a developing device used in the image forming apparatus according to an embodiment of the present invention.
Figure 4B:
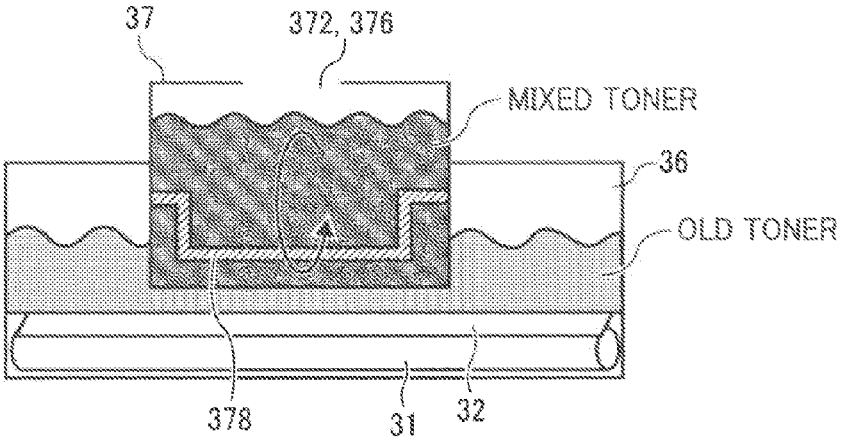
Figure 4C:
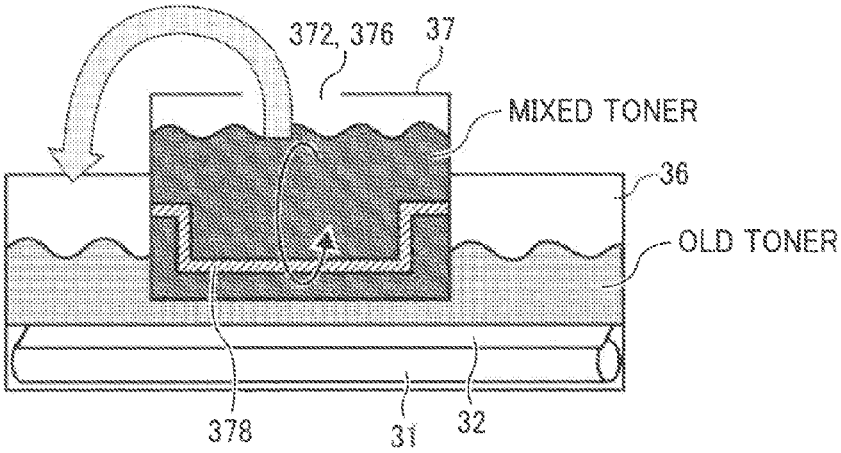

FIGS. 4A to 4C are schematic diagrams of the developing device used in the image forming apparatus according to an embodiment of the present invention. FIGS. 4A to 4C illustrate the developing device 30 with the toner supply container 37 accommodated therein. As shown in FIG. 4A, the image forming operation is performed over time by the developing device 30 and the toner storage unit 36 of the developing device 30 stores used old toner (hereinafter, "old toner") therein. The toner supply container 37 stores unused new toner to be supplied (hereinafter, "new toner") therein. The toner supply container 37 has an inlet port 372 from which the new toner is taken in, a supply port 376 from which the toner is supplied to the developing device 30, and a stirring member 378. The old toner is conveyed from the toner storage unit 36 of the developing device 30 into the toner supply container 37.

As shown in FIG. 4B, when the old toner is taken into the toner supply container 37, the old toner is mixed with the new toner. By operation of the stirring member 378 set in the toner supply container 37, the old toner is stirred and mixed with the new toner within the toner supply container 37 and thus the mixed toner is produced.

After that, as shown in FIG. 4C, the mixed toner produced within the toner supply container 37 is supplied through the supply port 376 to the developing device 30. The toner can be conveyed to the developing device 30 between the toner storage unit and the toner supply container 37 by using any of an auger, a screw, and a coil; however, if the toner is conveyed through a flexible conveying path, a coil is preferable. The conveying path is well-known and detailed description is omitted here.

Mutual charging is described below. The mutual charging occurs when the toner in the toner supply container (new toner) is mixed with the toner coming from the developing device (old toner).

Figure 5:
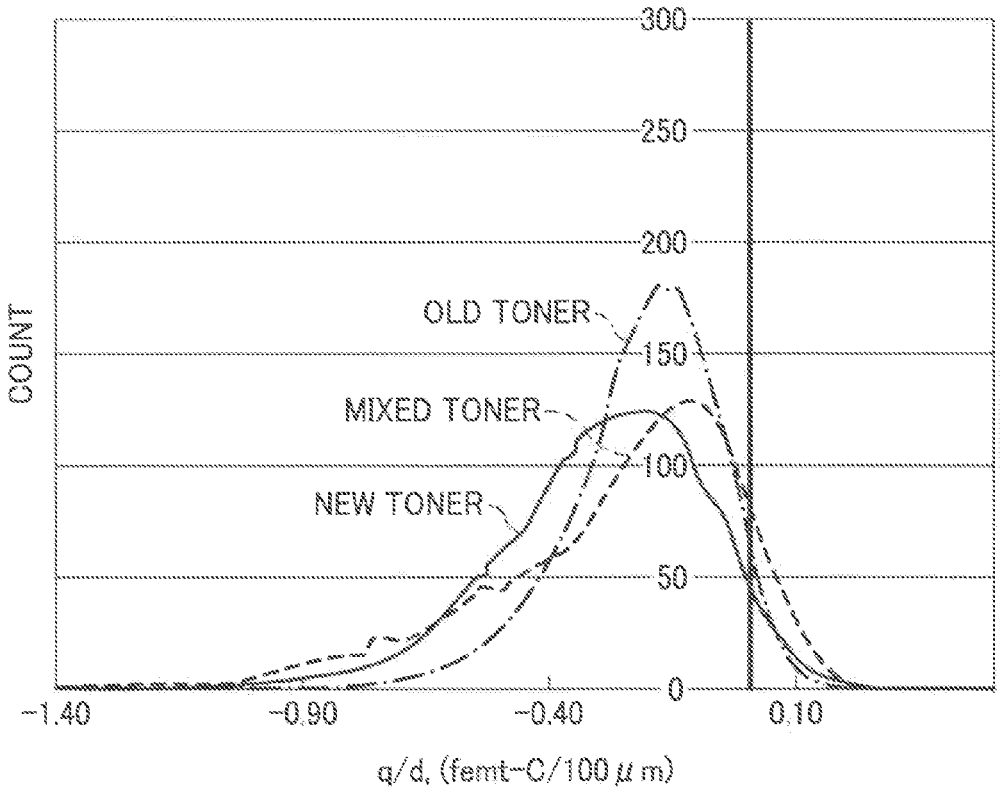
FIG. 5 is a graph of an amount-of-charge distribution of toner.

FIG. 5 is a graph of the amount-of-charge distribution of toner. The horizontal axis is the rate of the amount of charge of one particle of toner to the radius of the particle of toner. The vertical axis is the number of measured particles of toner.

The amount-of-charge distribution of the used old toner is measured using particles of toner that are present on the developing roller. The amount-of-charge distribution of the new toner is measured using particles of toner that are supplied from the toner supply container 37 and form a thin layer on the developing roller. The amount-of-charge distribution of the mixed toner is measured using particles of toner that are a mixture of the new toner and the used old toner produced within the toner supply container. After the mixed toner is supplied to the developing device 30, a thin layer of the mixed toner is formed on the developing roller, and the amount-of-charge distribution is measured using the toner that is present on the developing roller.

Parallel to the measurement, an image is formed by using the developing device 30 with these toners and the level of scumming of the photosensitive element is measured in order to evaluate the quality of the formed image. The level of scumming is measured independently by using each of the new toner and the old toner. After that, the old toner is supplied to the new toner and images are formed with the mixed toner. The image formed immediately after the toner mixture shows the level of scumming higher than the levels of scumming of both the new toner and the old toner before mixing. However, the image after 100-sheet continuous printing shows, because the old toner and the new toner are mixed well, a lower level of scumming, i.e., the image quality is improved. This proves that the image quality improves after a certain time period has elapsed since mixing. Therefore, the mixed toner herein means not simply mixed toner but well mixed toner. The amount-of-charge distribution of the mixed toner represents that of the well mixed toner.

The amount-of-charge distribution of the new toner shows a high amount of charge per particle and a wide width of the distribution. The amount-of-charge distribution of the old toner shows a low amount of charge per particle and a narrow width of the distribution. In contrast, the mixed toner contains, because the new toner and the old toner are mixed, an increased amount of toner with a high amount of charge and an increased amount of toner oppositely charged.

This is rather called a phenomenon particular to a nonmagnetic or magnetic monocomponent toner. If a widely-used two-component developer that contains both toner and carrier is used, in most cases, the toner of the unused developer shows a high amount of charge and a narrow width of the distribution, while the toner of the used old developer shows a low amount of charge and a wide width of the distribution. Therefore, if a monocomponent developer is used, it is preferable to use the toner that is a mixture of the new toner and the used old toner.

FIGS. 6A to 6E are schematic diagrams of a developing device used in an image forming apparatus according to another embodiment of the present invention.

To prevent the situation where the new toner is directly conveyed to the developing device 30 and the printing operation is performed under the mutual charging, the new toner is mixed with the old toner well within the toner supply container 37, and after the mutual charging subsides, mixed toner is supplied to the developing device 30.

Figure 6A:
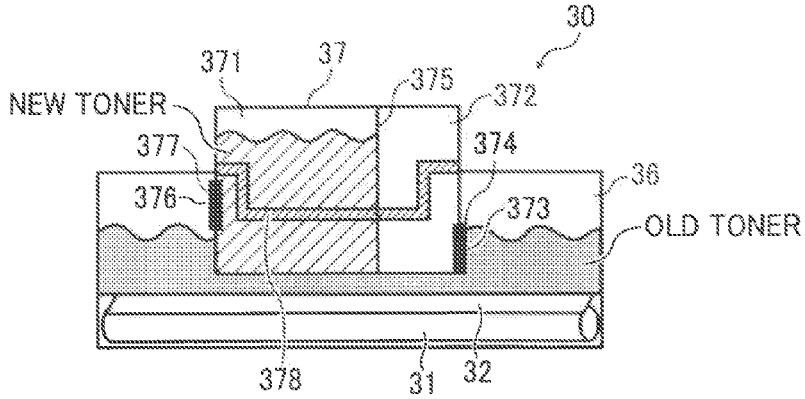
FIGS. 6A to 6E are schematic diagrams of a developing device used in an image forming apparatus according to another embodiment of the present invention.

The toner supply container 37 shown in FIG. 6A includes a new-toner storage chamber 371 that stores therein unused new toner to be supplied; a toner mixing chamber 372 into which the old toner is conveyed; an inlet port 373 through which the old toner is conveyed to the toner mixing chamber 372; an inlet-port shutter 374 that opens and closes the inlet port; a partition plate 375 that separates the new-toner storage chamber 371 from the toner mixing chamber 372; the supply port 376 through which the mixed toner, which is a mixture of the new toner and the old toner, is conveyed from the toner supply container 37 to the developing device 30; a supply-port shutter 377 that opens and closes the supply port; and the toner-supply-container stirring member 378 for stirring the new toner and the old toner.

Figure 6B:
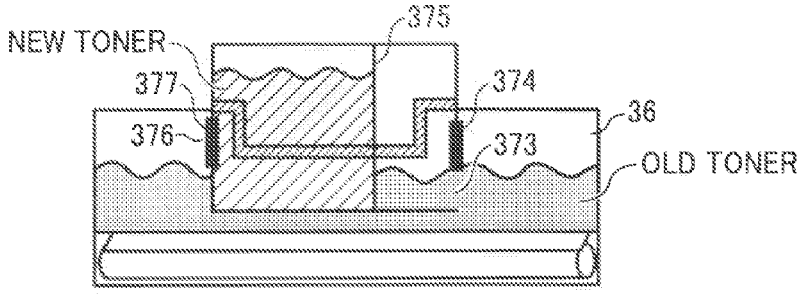

As shown in FIG. 6B, when the inlet-port shutter 374 of the toner supply container 37 opens, through the inlet port 373, the old toner is conveyed from the toner storage unit 36 of the developing device 30 to the toner mixing chamber 372. Because there is the partition plate 375 in the toner supply container 37, the new toner is not mixed with the old toner in this situation.

Figure 6C:
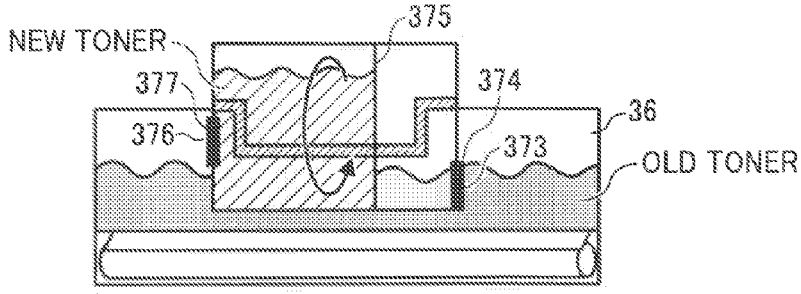

As shown in FIG. 6C, after a predetermined amount of the old toner is taken into the toner mixing chamber, the inlet-port shutter 374 is closed, thereby setting the inlet port 373 closed.

Figure 6D:
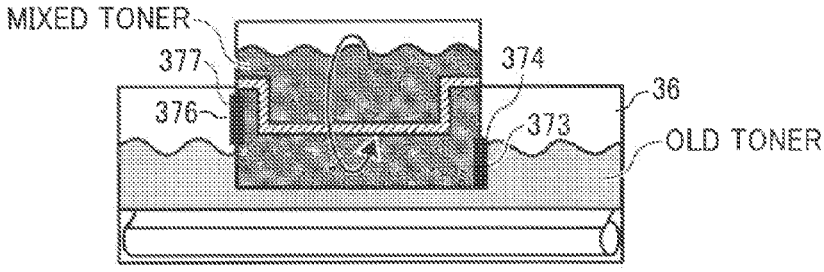

As shown in FIG. 6D, the partition plate is then removed from the toner supply container 37 and thus a single chamber that contains both the new-toner storage chamber 371 and the toner mixing chamber 372 is formed. The new toner and the old toner are mixed well by rotation of the toner-supply-container stirring member 378 and thus the mixed toner is produced.

Figure 6E:
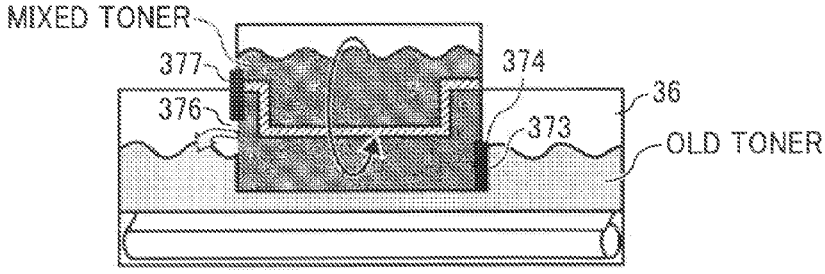

As shown in FIG. 6E, after the mixed toner is produced, the supply-port shutter 377 of the toner supply container 37 opens and, through the supply port 376, the mixed toner is supplied from the toner supply container 37 to the toner storage unit 36 of the developing device 30. As described above, the new toner is supplied for toner replenishment.

The toner-supply-container stirring member 378 is, for example, a stirring puddle, a stirring screw, and a coil and stirs the toner.

The toner supply container 37 is separated into two chambers, one chamber or the toner mixing chamber 372 being used to mix the new toner with the old toner. When the toner supply container 37 is set to the developing device 30, the inlet-port shutter 374 of the toner mixing chamber 372 opens and the inlet port 373 opens. By arranging the inlet port 373 under the level of the old toner within the toner storage unit 36, the old toner from the developing device 30 flows into the toner mixing chamber 372. An elastic thin plate may be arranged at the side of the developing device 30 such that the toner flows along the inclined surface of the thin plate.

When the toner flows in, the inlet port 373 closes. The partition plate 375 that separates the new-toner storage chamber 371 from the toner mixing chamber 372 is then removed and thus the new toner is mixed with the old toner. If the toner-supply-container stirring member 378 is used, they are mixed in an efficient manner. After a predetermined mixing period, the difference between the charge of the new toner and the charge of the old toner decreases, which decreases the mutual charging.

After that, the supply port 376 opens and the mixed toner is then supplied. With this configuration, the toner would not be supplied to the developing device 30 before the toner is not sufficiently mixed. Thus, the scumming does not occur.

Moreover, the photosensitive element 11 and at least one unit selected from the charging device 20, the developing device 30, and the cleaning device 40 are formed integrally as the process cartridge 10 that is detachable from the image forming apparatus 1. Because these units are formed integrally as one cartridge, the process cartridge 10 that maintains a high image quality is implemented and the process cartridge 10 that facilitates maintenance and exchange of the imaging unit is provided.

First Example

A stirring puddle is used as the toner-supply-container stirring member 378 and toners are mixed for one minute or longer. The mixing ratio indicates that 50 grams of new toner is mixed with 20 grams of old toner. Because the developing device 30 has 50 grams of old toner, the developing device 30 can form an image. Further, the mixed toner is supplied into the developing device 30 at one time. When 70 grams of new toner is supplied at one time, recognizable dots are formed on the background of a sample print. On the other hand, when 70 grams of the mixed toner is supplied, no recognizable dots are formed on the background of a sample print. The toner used in this example is toner powders of 8 μm to 9 μm. The toner contains a polyester resin, a carbon black as a pigment, a wax as a mold lubricant with the ratio of 100:10:5 and further contains silica as an additive agent.

Second Example

In the same manner as in the first example, different amounts of the old toner are taken from the developing device 30 into the toner supply container 37. After toner supply, an image is formed and toner or similar present on the non-imaging area of the surface of the photosensitive element is transferred to a tape and the scumming is measured using the tape with respect to L*.

L* is L* of the L*a*b* color system. The L*a*b* color system is called "CIE1976 (L*a*b*) color system" and set in JISZ 8729 by Japanese Industrial Standards Committee. L* is called "lightness index" and indicates the lightness. Therefore, as the value of L* increases, it is brighter and the level of scumming decreases. L* is measured using a commercially available colorimeter.

If L* is 90 or higher, a sample image with no scrumming is formed and less toner is consumed wastefully, and, the amount of wasted toner is ignorable in actual cases.

The values of L* are measured with various mixed toner having different ratios between the new toner and the old toner. A stirring puddle is used as the toner-supply-container stirring member 378 and the toners are mixed for one minute or longer.

TABLE 1

<Values of L* with various ratios between new toner and old toner>

| Ratio between new toner and old toner | Value of L* |
|---|---|
| 50:20 | 88 |
| 50:30 | 90 |
| 50:50 | 90 |

It is clear from Table 1 that if the ratio between the new toner and the old toner is 5:3 or higher, a good image is formed and the amount of toner consumed due to scrumming is suppressed.

Third Example

In the same manner as in the first example, different amounts of new toner are supplied from the toner supply container 37 into the developing device 30. After toner supply, an image is formed and toner or similar present on the non-imaging area of the surface of the photosensitive element is transferred to a tape and the scumming is measured using the tape with respect to L*.

The mixed toner is supplied every 10 seconds with the amount 5 grams or 10 grams each time. The mixed toner is also supplied at one time with 50 grams.

TABLE 2

<Values of L* with different amount of toner supplied>

| Amount of toner supplied (amount at every 10 seconds/total amount) | Value of L* |
|---|---|
| 5 g/50 g | 90 |
| 10 g/50 g | 90 |
| 50 g/50 g | 89 |

It is clear from Table 2 that the manner is recommended in which toner is supplied at fixed intervals with a small amount each time.

Fourth Example

Although the toner powders from 8 μm to 9 μm are used, polymerized toner that is produced using a polymerization technique is also effective. More particularly, L* 90 or higher is measured by using a polymerized toner with the degree of circularity 0.98 and the volume average particle diameter from 5 μm to 6 μm having the surface made of polyester and/or styrene acrylic.

The image forming apparatus according to an embodiment of the present invention mixes the toner that is present in the developing device before toner supply with the toner for toner supply that is within the toner supply container 37 and supplies, to the developing device, the mixed toner that has no mutual charge and has a potential close to the potential of the toner present in the developing device, thereby suppressing the mutual charging that occurs during the toner supply. This enables the forming of high-quality images with less scumming.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:
an image carrier on which a latent image is formed;
a charging device that charges the image carrier;
an exposing device that irradiates the image carrier, thereby forming a latent image on the image carrier;
a developing device that develops the latent image into a visible image by using a monocomponent developer that is carried and transferred by a developer carrier and that is charged to a predetermined polarity; and
a toner supply container that is installed in the developing device for toner supply,
wherein:
used old toner is conveyed from the developing device to the toner supply container and mixed with unused new toner within the toner supply container and thus a mixed toner is produced,
the mixed toner is supplied to the developing device, and
an inlet port of the developing device opens when the toner supply container is installed to the developing device.

2. The image forming apparatus according to claim 1, further comprising:
a process cartridge detachable from a main body of the image forming apparatus, wherein the process cartridge includes at least the image carrier and the developing device formed integrally.

3. An image forming apparatus comprising:
an image carrier on which a latent image is formed;
a charging device that charges the image carrier;
an exposing device that irradiates the image carrier, thereby forming a latent image on the image carrier;
a developing device that develops the latent image into a visible image by using a monocomponent developer that is carried and transferred by a developer carrier and that is charged to a predetermined polarity; and
a toner supply container that is installed in the developing device for toner supply,
wherein:
used old toner is conveyed from the developing device to the toner supply container and mixed with unused new toner within the toner supply container and thus a mixed toner is produced,
the mixed toner is supplied to the developing device, and
a supply port through which the mixed toner is supplied to a toner storage unit opens after the mixing.

4. The image forming apparatus according to claim 3, wherein the mixing is completed at a predetermined time.

5. The image forming apparatus according to claim 3, further comprising:
a process cartridge detachable from a main body of the image forming apparatus, wherein the process cartridge includes at least the image carrier and the developing device formed integrally.

6. An image forming apparatus comprising:
an image carrier on which a latent image is formed;

a charging device that charges the image carrier;

an exposing device that irradiates the image carrier, thereby forming a latent image on the image carrier;

a developing device that develops the latent image into a visible image by using a monocomponent developer that is carried and transferred by a developer carrier and that is charged to a predetermined polarity; and a toner supply container that is installed in the developing device for toner supply, wherein:

used old toner is conveyed from the developing device to the toner supply container and mixed with unused new toner within the toner supply container and thus a mixed toner is produced, the mixed toner is supplied to the developing device, and an amount of the old toner that is conveyed from the developing device to the toner supply container is 0.6 time or more of an amount of the new toner present within the toner supply container.

7. The image forming apparatus according to claim 6, further comprising:

a process cartridge detachable from a main body of the image forming apparatus, wherein the process cartridge includes at least the image carrier and the developing device formed integrally.

8. An image forming apparatus comprising:

an image carrier on which a latent image is formed;

a charging device that charges the image carrier;

an exposing device that irradiates the image carrier, thereby forming a latent image on the image carrier;

a developing device that develops the latent image into a visible image by using a monocomponent developer that is carried and transferred by a developer carrier and that is charged to a predetermined polarity; and a toner supply container that is installed in the developing device for toner supply, wherein:

used old toner is conveyed from the developing device to the toner supply container and mixed with unused new toner within the toner supply container and thus a mixed toner is produced, the mixed toner is supplied to the developing device, the toner supply container includes a first chamber that stores the new toner to be supplied and a second chamber that stores no toner, and after the toner supply container is installed to the developing device and the old toner is conveyed to the second chamber, the old toner is mixed with the new toner.

9. The image forming apparatus according to claim 8, further comprising:

a process cartridge detachable from a main body of the image forming apparatus, wherein the process cartridge includes at least the image carrier and the developing device formed integrally.

* * * * *